US009502761B2

(12) United States Patent
Itoh et al.

(10) Patent No.: US 9,502,761 B2
(45) Date of Patent: Nov. 22, 2016

(54) ELECTRICALLY SMALL VERTICAL SPLIT-RING RESONATOR ANTENNAS

(71) Applicants: THE REGENTS OF THE UNIVERSITY OF CALIFORNIA, Oakland, CA (US); NEC CORPORATION, Tokyo (JP)

(72) Inventors: Tatsuo Itoh, Rolling Hills, CA (US); Yuandan Dong, Los Angeles, CA (US); Hiroshi Toyao, Kanagawa (JP)

(73) Assignees: NEC CORPORATION, Tokyo (JP); THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 388 days.

(21) Appl. No.: 14/088,651

(22) Filed: Nov. 25, 2013

(65) Prior Publication Data

US 2014/0203987 A1 Jul. 24, 2014

Related U.S. Application Data

(63) Continuation of application No. PCT/US2012/043641, filed on Jun. 21, 2012.

(60) Provisional application No. 61/500,569, filed on Jun. 23, 2011.

(51) Int. Cl.
*H01Q 9/16* (2006.01)
*H01Q 1/50* (2006.01)
(Continued)

(52) U.S. Cl.
CPC ..... *H01Q 1/50* (2013.01); *H01Q 1/2266* (2013.01); *H01Q 7/00* (2013.01); *H01Q 9/0407* (2013.01);
(Continued)

(58) Field of Classification Search
CPC ..... H01Q 1/50; H01Q 7/00; H01Q 9/16; H01Q 1/2266; H01Q 9/0407; H01Q 9/0414; H01Q 9/0421
USPC ..... 343/793, 866, 700 MS, 909
See application file for complete search history.

(56) References Cited

U.S. PATENT DOCUMENTS 4,700,194 A 10/1987 Ogawa et al.
6,642,895 B2 * 11/2003 Zurcher ..... G04G 21/04 343/700 MS (Continued)

FOREIGN PATENT DOCUMENTS

CN 101345337 A 1/2009
CN 101471494 A 7/2009

(Continued)

OTHER PUBLICATIONS

Chinese Patent Office, First Office Action issued on Nov. 15, 2014 for corresponding Chinese Patent Application No. 201280029067.7, pp. 1-10 with Claims examined pp. 11-17 (pp. 1-17).

(Continued)

*Primary Examiner* — Dieu H Duong
(74) *Attorney, Agent, or Firm* — O'Banion & Ritchey LLP; John P. O'Banion

(57) ABSTRACT

A vertical split ring resonator antenna is disclosed, comprising a substrate having an upper surface and lower surface, an interdigitated capacitor coupled to the upper surface of the substrate and ground coupled to the lower surface. The interdigitated capacitor includes a first planar segment and a second planar segment, each having interdigitated fingers that are separated by a gap disposed between the first planar segment and second planar segment. The interdigitated capacitor is coupled to the substrate to form a vertical split ring resonator.

34 Claims, 15 Drawing Sheets

(51) Int. Cl.
*H01Q 1/22* (2006.01)
*H01Q 9/04* (2006.01)
*H01Q 7/00* (2006.01)

(52) U.S. Cl.
CPC ..... *H01Q 9/0414* (2013.01); *H01Q 9/0421* (2013.01); *H01Q 9/0442* (2013.01); *H01Q 9/16* (2013.01)

(56) References Cited

U.S. PATENT DOCUMENTS

| | | | | |
|---|---|---|---|---|
| 2005/0030246 | A1* | 2/2005 | Durham | H01Q 1/38 343/795 |
| 2007/0176827 | A1* | 8/2007 | Itoh | H01Q 13/206 343/700 MS |
| 2011/0128187 | A1 | 6/2011 | Ju et al. | |
| 2012/0075157 | A1* | 3/2012 | Kwak | H01Q 1/245 343/841 |

FOREIGN PATENT DOCUMENTS

| | | | |
|---|---|---|---|
| CN | 101950858 | A | 1/2011 |
| WO | 2007-144738 | A1 | 12/2007 |
| WO | 2012-177946 | A2 | 12/2012 |

OTHER PUBLICATIONS

Dong and Itoh, "Miniaturized Patch Antennas loaded with Complementary Split-Ring Resonators and Reactive Impedance Surface," Antennas and Propagation (EUCAP), Proceedings of the 5th European Conference, Apr. 11-15, 2011, pp. 2415-2418.

C. Lee, K. M. Leong, and T. Itoh, "Composite right/left-handed transmission line based compact resonant antennas for RF module integration," IEEE Trans. Antennas Propag., vol. 54, No. 8, pp. 2283-2291, Aug. 31, 2006.

Korean Intellectual Property Office, International Search Report and Written Opinion issued on Jan. 10, 2013, for corresponding international patent application No. PCT/US2012/043641, with claims searched, pp. 1-15.

Ha et al. "Design of a small resonant antenna using metamaterial based on transmission line approach," IEEE Antennas and Probagation Society International Symposium, IEEE 2010, pp. 1-4.

Xia and Wang "A wireless sensor using left-handed metamaterials," Wireless Communications, Networking and Mobile Computing, 4th International Conference, IEEE, 2008, pp. 1-3.

L. J. Chu, "Physical limitations of omni-directional antennas," Journal of Applied Physics, vol. 19, issue 12, pp. 1163-1175, Dec. 1948.

C. Lee, K. M. Leong, and T. Itoh, "Composite right/left-handed transmission line based compact resonant antennas for RF module integration," IEEE Trans. Antennas Propag., vol. 54, No. 8, pp. 2283-2291, 2006.

Park et al., "Epsilon negative zeroth-order resonator antenna," IEEE Trans. Antennas Propag., vol. 55, No. 12, pp. 3710-3712, Dec. 2007.

R. W. Ziolkowski and A. Erentok, "Metamaterial-based efficient electrically small antennas," IEEE Trans. Antennas Propag., vol. 54, No. 7, pp. 2113-2130, Jul. 2006.

K. B. Alici and E. Ozbay, "Electrically small split ring resonator antennas," Journal of applied physics, vol. 101, 2007.

I. K. Kim, V. V. Varadan, "Electrically small, millimeter wave dual band meta-resonator antennas," IEEE Trans. Antennas Propag., vol. 58, No. 11, pp. 3458-3463, Nov. 2010.

* cited by examiner

ELECTRICALLY SMALL VERTICAL SPLIT-RING RESONATOR ANTENNAS

CROSS-REFERENCE TO RELATED APPLICATIONS

This application is a 35 U.S.C. §111(a) continuation of PCT international application number PCT/US2012/043641 filed on Jun. 21, 2012, incorporated herein by reference in its entirety, which is a nonprovisional of U.S. provisional patent application Ser. No. 61/500,569 filed on Jun. 23, 2011, incorporated herein by reference in its entirety. Priority is claimed to each of the foregoing applications.

The above-referenced PCT international application was published as PCT International Publication No. WO 2012/177946 on Dec. 27, 2012 and republished on Mar. 7, 2013, which publications are incorporated herein by reference in their entireties.

STATEMENT REGARDING FEDERALLY SPONSORED RESEARCH OR DEVELOPMENT

Not Applicable

INCORPORATION-BY-REFERENCE OF MATERIAL SUBMITTED IN A COMPUTER PROGRAM APPENDIX

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. §1.14.

BACKGROUND OF THE INVENTION

1. Field of the Invention

This invention pertains generally to compact antennas, and more particularly to electrically small, split-ring antennas.

2. Description of Related Art

The general purpose of an electromagnetic antenna is to launch energy into free space. It is well known that small physical size, low cost, broad bandwidth, and good radiation efficiency are desirable features for an integrated antenna in the system. It is also well known that generally the quality factor (Q) and the radiation loss of the antenna are inversely related to the antenna size. Therefore those requirements are usually contradictory and traditional electrically small antennas (ESAs) are considered to exhibit poor radiation performance. Existing small antenna designs cannot provide good performance for practical applications.

Some of the antenna designs improve their performance by loading with the metamaterials, which is difficult to realize. For example, a PIFA type or quarter-wavelength microstrip patch antenna has been proposed for size reduction.

Accordingly, an object of the present invention is the use of a vertical split-ring resonator as a metamaterial particle to reduce the antenna size.

BRIEF SUMMARY OF THE INVENTION

An aspect of the present invention is a vertical split-ring resonator loop-type structure with an interdigital capacitor to allow the miniaturization and efficient radiation. The structure employs a very compact feeding network and a small reactive impedance surface, resulting in a very small footprint size.

In a preferred embodiment, the present invention comprises a miniaturized patch antenna with a vertical split-ring resonator configuration loaded with a small reactive impedance surface (RIS), including a reduced ground size. The RIS serves to reduce the resonance frequency. A Strong E-field is generated around the interdigital capacitor, which radiates a quasi-omni-directional wave. The antenna is electrically small, exhibiting a size of less than 12 mm*6 mm*3 mm at 2.4 GHz, and has radiation efficiency of approximately 70%. The loss is mainly a result of dielectric loss, where a high loss tangent (0.009) is assumed (the loss tangent for typical materials is only 0.001. The antenna also exhibits a good bandwidth performance, around 2%-3%.

In one embodiment, the antenna comprises an interdigital capacitor at the open split position to reduce the resonance frequency.

In another embodiment, a small reactive impedance surface is attached a little below the interdigital capacitor, which is used to reduce the resonance frequency and improve the radiation performance.

In one embodiment, the antenna of the present invention may be integrated on small handset components for wireless communication systems. The antenna comprises a planar structure that can be very easily integrated with other circuits. For example, the electrically small antenna of the present invention may be installed on notebook computers for wireless (e.g. Bluetooth) communication.

The antenna of the present invention advantageously combines small size, good radiation efficiency and bandwidth performance. In addition, the emitted omni-directional radiation patterns are advantageous for handset communication.

The antenna of the present invention also has an internal matching network which can be easily matched from a coaxial probe to the antenna. No extra matching circuit is necessary, which reduces the overall size.

Another aspect of the present invention is an antenna having a planar structure and can be fabricated by the standard PCB process at a low cost. In one embodiment, the antenna may be configured for practical 2.4 GHz wireless Local Area Network (LAN) application. Alternatively, the antenna may be readily scaled up or down and applied in other communication systems. For example, the VSRR antennas of the present invention may be scaled and adapted in lower or upper frequency ranges, such as for the UHF RFID applications. A small RIS, which is preferably constructed of a two unit-cell, may also be employed to provide further miniaturization.

Arbitrary miniaturization factor can be attained, yet the radiation efficiency may be sacrificed for a particularly small size. Different feeding configurations may also be implemented. Furthermore, by changing the configuration of the ground, the VSRR antenna, which is considered an equivalent magnetic dipole antenna, can behave as a miniaturized electric dipole-type antenna. This dipole antenna can be easily matched to a 50Ω source.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Figure 1:
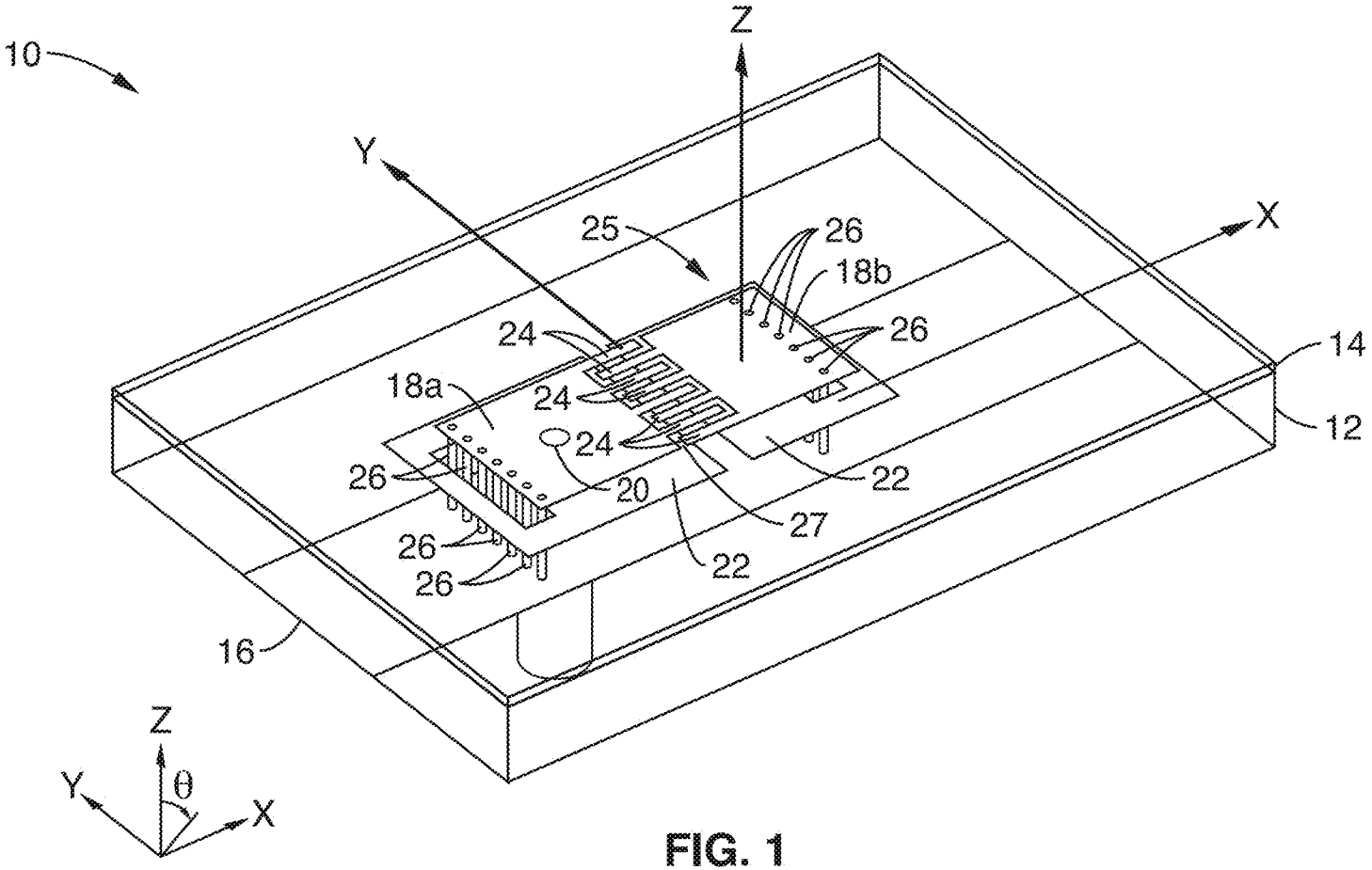
FIG. 1 shows a perspective view of the geometrical layout of an inductively-fed Vertical Split-Ring Resonator (VSRR) antenna of the present invention.
Figure 2:
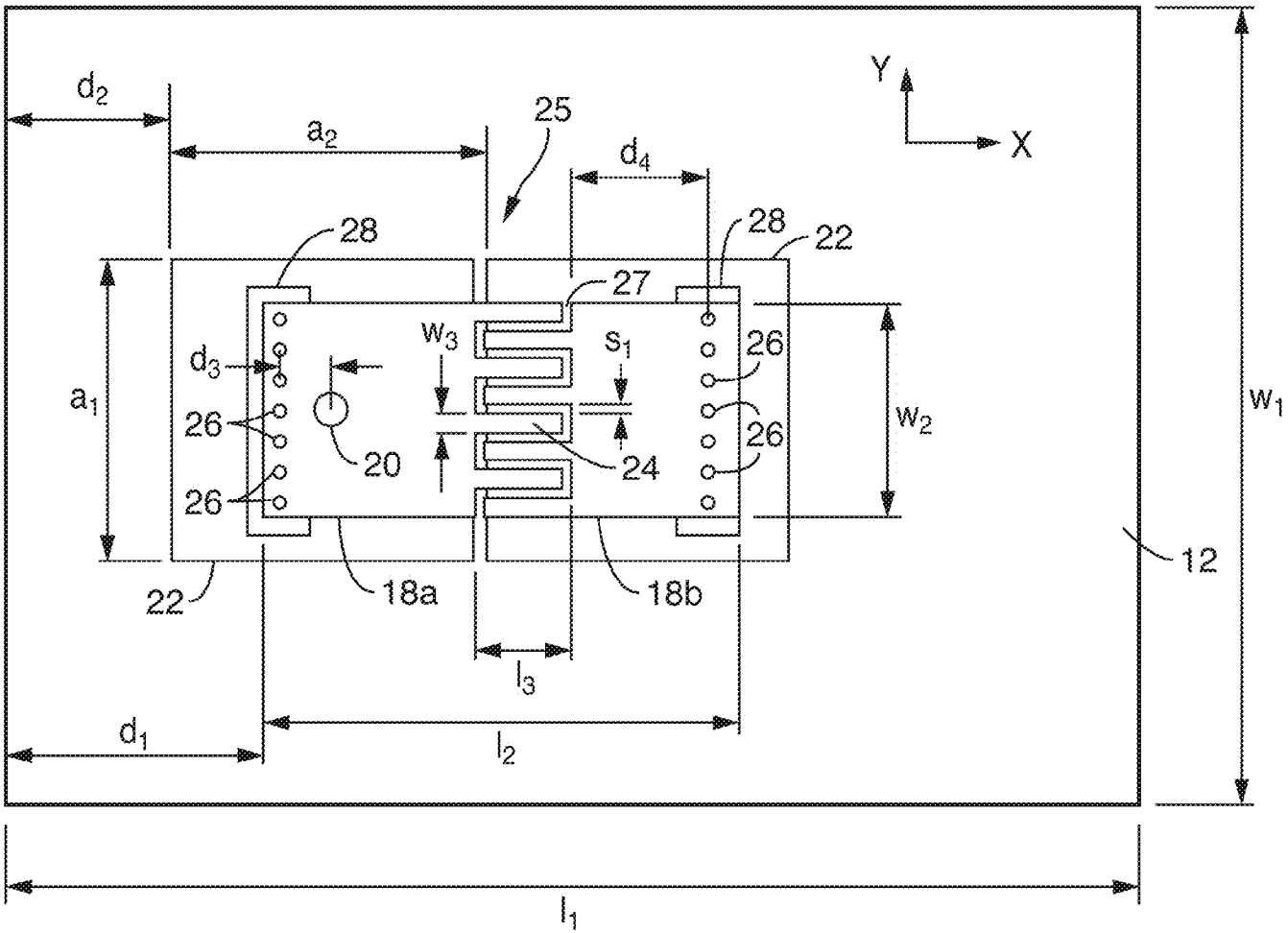
FIG. 2 shows a plan view of the geometrical layout, with dimensions, of the inductively-fed VSRR antenna of FIG. 1.
Figure 3:
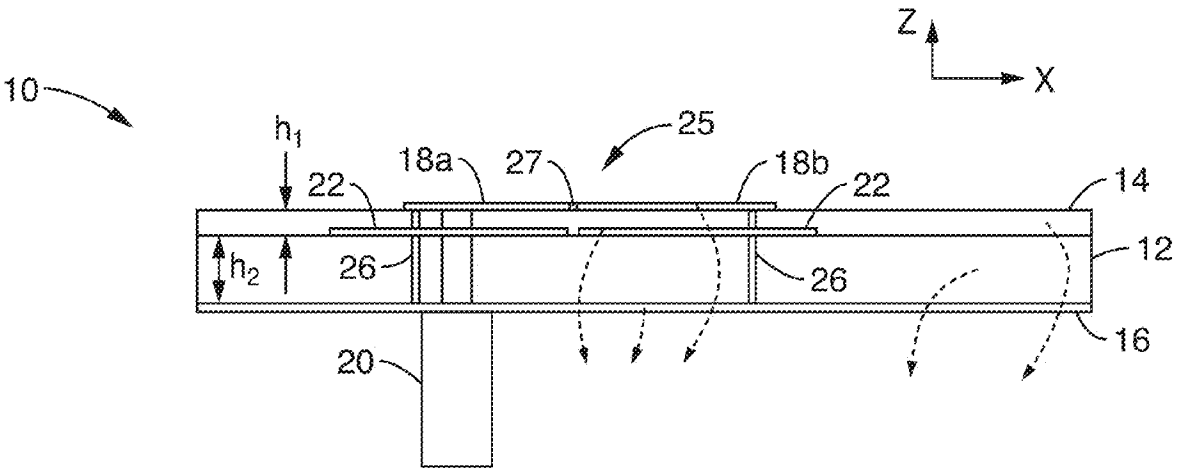
FIG. 3 shows a side view of the geometrical layout, of the inductively-fed VSRR antenna of FIG. 1.

FIG. 1 shows a perspective view of the geometrical layout of an inductively-fed Vertical Split-Ring Resonator (VSRR) antenna 10 of the present invention. FIG. 2 shows a plan view of the geometrical layout, with dimensions, of the inductively-fed VSRR antenna 10 of FIG. 1. FIG. 3 shows a side view of the geometrical layout, of the inductively-fed VSRR antenna 10 of FIG. 1. An input comprising a coaxial feeding probe 20 is directly connected to the top surface 14 that forms the Split-Ring Resonator (SRR), which can be represented by a series inductor. The interdigitated capacitor 25, which is the split of the VSRR, is the main radiator of the antenna 10. The interdigitated capacitor 25 is split into first planar side 18*a* and second planar side 18*b* and interface via a series of parallel interdigitated fingers 24. The two ends first planar side 18*a* and second planar side 18*b* are shorted to the ground 16 (with vias 26), making the antenna 10 act as an open loop structure, which also looks like a vertical split ring resonator structure. The top surface 14 and plurality of metalized via-holes 26 at the two ends of the first planar side 18*a* and second planar side 18*b*, together with the ground 16, constitute a capacitor-loaded half-wavelength loop resonator forming an SRR configuration.

The antenna 10 may include a reactive impedance surface (RIS) 22, which is composed of two metallic square patches printed on a PEC-backed dielectric substrate 12, and introduced below the top surface 14. As seen in FIGS. 1 and 2, two rectangular holes 28 and a circular hole (not shown) have been cut away on the RIS 22 in order to let the vias 26 and the feeding probe 20 to pass through to the upper surface 14 and interdigitated capacitor 25. While it may not be entirely accurate to consider a two-unit-cell structure as a "surface," since the wave only interacts intensively with the particular surface area below the radiating slot, it is still shown to be a small surface able to offer characteristics similarly to that of a two dimensional periodic surface.

While the RIS 22 provides beneficial features to the antenna 10, it is also appreciated that the antenna may operate without benefit of the RIS 22. While such configuration may not be optimal in some respects, it is understood that the VSRR antenna 10 configured without it may still provide significant benefit over current antenna designs.

The antenna 10 is a three-layer structure (two-layer for the case without RIS), where the top 14 and bottom 12 dielectric substrate preferably comprise "MEGTRON 6" with a relative permittivity of 4.02 and a loss tangent of 0.009 at 2.4 GHz. It should be pointed out that this substrate is considered to be a little lossy compared with other low-loss material like the Rogers substrate, which exhibits a loss tangent around 0.0009-0.002. The RIS 22, interdigitated capacitor 25, and ground 16 preferably comprise copper metal (approximately 35-40 μm thick), which is assumed to have a $5.8\times10^7$ Siemens/m conductivity. It is appreciated that other materials may also be considered.

Figure 4:
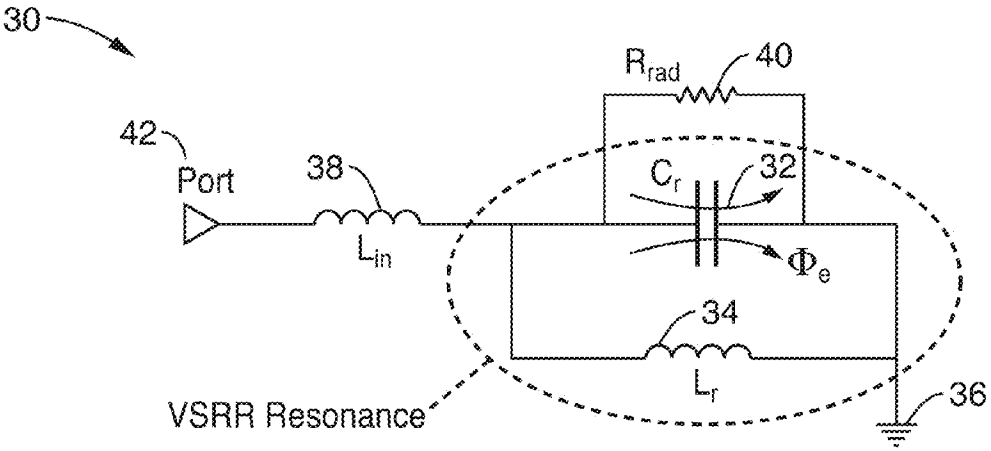
FIG. 4 shows a schematic diagram of a representative circuit model of the inductively-fed VSRR antenna of FIG. 1

The inductively fed VSRR antenna 10 is roughly represented by the circuit model 30 shown in FIG. 4. The VSRR antenna 10 is modeled as a high-Q LC resonator with a parallel radiation resistance ($R_{rad}$) 40 associated with a combination of the components and the capacitor $C_r$ 32 associated with the interdigitated capacitor 25. The series inductor $L_{in}$ 38 indicates the direct connection or coupling between the probe 20 (from port 42) and VSRR 10. Inductor $L_r$ 34 is indicative of inductance generated from loop metal vias 26 and ground 16 (36).

The circuit 30 is excited by simply applying a voltage difference across capacitor 25 which generates current along the loop and radiates energy, and more specifically, induces an axial magnetic field inside the loop. In this manner, circuit 30 is equivalent to a magnetic dipole placed along the y-direction above a PEC surface. By increasing the value of $L_r$ or $C_r$, the resonance frequency is reduced. By loading the inductive RIS 22, the overall $L_r$ value can be enhanced, which leads to a miniaturization of the antenna 10 size.

An inductively fed antenna according to the geometry of antenna 10 of FIGS. 1-3 was fabricated and tested, with and without RIS 22. Dimensions for the antenna were $a_1$=8.0 mm, $a_2$=8.15 mm, $h_1$=0.4 mm, $h_2$=2.6 mm, $s_1$=0.22 mm, $l_1$=28.6 mm, $w_1$=20 mm, $l_2$=11.94 mm, $w_2$=5.38 mm $l_3$=2.42 mm, $w_3$=0.48 mm, $d_1$=6.56 mm, $d_3$=2.29 mm, $d_3$=1.28 mm and $d_4$=3.4 mm. There are seven vias 26 on each of the two ends 18*a* and 18*b* with a radius of 0.15 mm and a spacing of 0.75 mm. The antenna is quite compact with an electrical size of $0.096\lambda_0\times0.043\lambda_0\times0.024\lambda_0$ and $0.112\lambda_0\times0.051\lambda_0\times0.028\lambda_0$ (with RIS) ($\lambda_0$ is the free space wavelength at the simulated resonance frequency), respectively. Note that the antenna without the RIS 22 had exactly the same parameter values with exception of the RIS 22.

Figure 5:
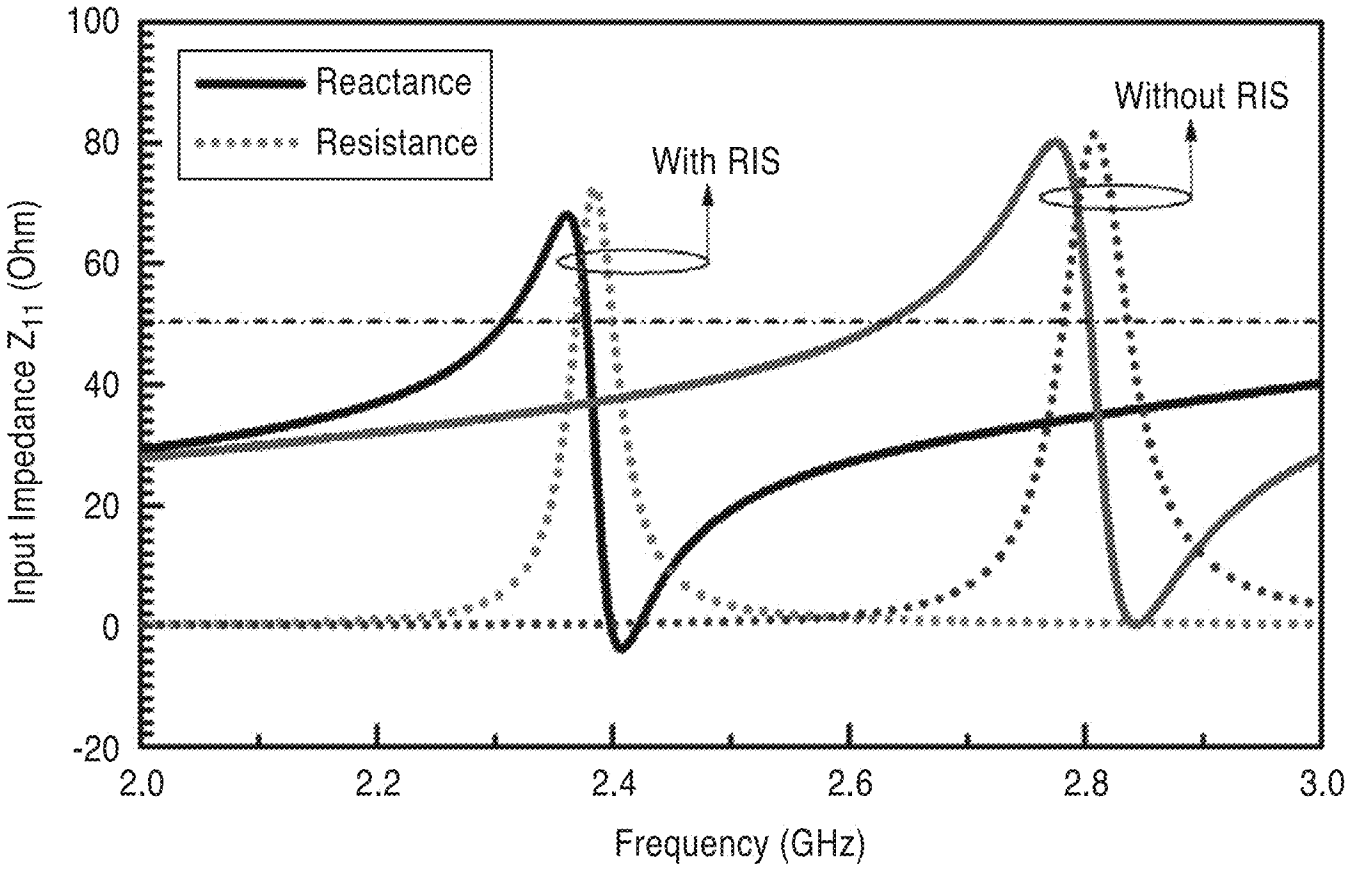
FIG. 5 shows that simulated complex input impedance for the inductively-fed VSRR antenna shown in FIG. 1 with or without the RIS.
Figure 6:
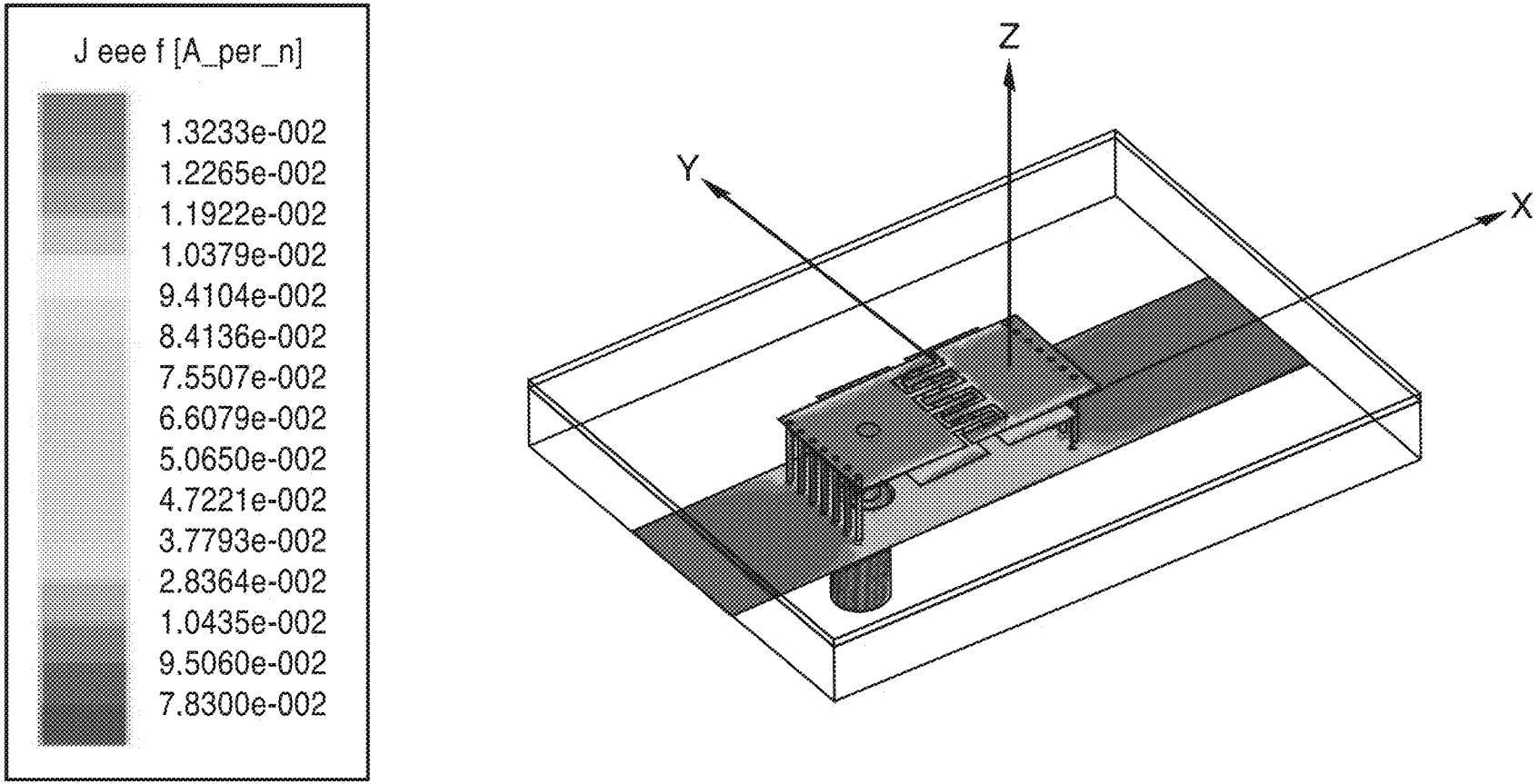
FIG. 6 illustrates a simulated current distribution for the inductively-fed VSRR antenna of FIG. 1.

FIG. 5 shows the simulated input impedance for the designed antennas with or without loading the RIS 22. It is seen that by loading the RIS 22, the initial resonance frequency has been moved down from 2.83 GHz to 2.4 GHz. Due to an inductive feeding, the observed reactance is almost positive. It is interesting to note that the matching can be optimized by changing the x-position of the feeding probe 20, as well as the number and spacing of the vias 26. FIG. 6 shows the current distribution for an antenna with RIS 22.

The model with the RIS 22 comprised of two dimensional periodic metallic patches printed on a grounded substrate 12. The periodicity of the patches 22 is much smaller than the wavelength. Considering a single cell illuminated with a TEM plane wave, PEC (Perfect Electric Conductor) and PMC (Perfect Magnetic Conductor) boundaries can be established around the cell. A PMC is a surface that exhibits a reflectivity of +1, whereas a PEC is a surface that exhibits a reflectivity of −1. The resulting structure can be modeled as a parallel LC circuit. The edge coupling of the square patch 22 provides a shunt capacitor and the short-circuited dielectric loaded transmission line can be modeled as a shunt inductor. The variation of the patch size $a_1$ and gap width ($a_2-a_1$) mainly changes the capacitance value, while the substrate thickness $h_2$ mainly affects the inductance value, all of which can be used to control the resonance frequency. The 180° reflection phase corresponds to a PEC surface while the 0° reflection phase corresponds to a PMC surface. Either an inductive RIS 22 (below the PMC surface frequency) or a capacitive RIS 22 (above the PMC surface frequency) can be obtained depending on the geometry and the operating frequency.

Due to the matching difficulty and loss problem, a PMC surface is generally not an optimal choice. An inductive RIS 22 is able to store the magnetic energy that thus increases the inductance of the circuit. Therefore, it can be used to miniaturize the size of the VSRR antenna 10, which is essentially an RLC parallel resonator. The inductive RIS 22 is also capable of providing a wider matching bandwidth and is therefore more suitable for antenna application.

However, since the tested antenna is very small (11.94 mm×5.38 mm only), two unit-cells are enough to cover the top plane circuit and this two-cell surface is far from being periodic and thus not really a "surface." The construction of a radiating element over the meta-surface (RIS) 22, using the equivalent circuit and unit-cell analysis, is just an approximation to qualitatively explain its working principle. Nevertheless, since the near field interaction mainly happens around the radiating aperture (the interdigital slot 27 between fingers 24), the two-unit-cell surface is still capable of achieving the main function of a periodic RIS. It is appreciated that using a cap (not shown) below the interdigital slot 27 could also enhance the capacitor value leading to the decrease of the resonance frequency.

To verify its impact, the RIS 22 configuration was varied and simulated. The obtained different reflection coefficient responses showed that the two-cell surface has totally different characteristics which confirms that it works much more like a two dimensional RIS.

The resonance frequency may be varied by adjusting the patch size $a_1$. When the size $a_1$ of the square patch 22 is small, the corresponding capacitor is reduced, which increases the antenna 10 resonance frequency. Note that when $a_1$ is equal to 5, the RIS 22 is completely covered by the top metal 18*a* and 18*b* as indicated by FIG. 2. Under this condition, still considerable frequency reduction is achieved compared with the un-loaded (non RIS 22) case.

By decreasing the width of the gap ($a_2-a_1$) between the patches 22, the resonance frequency can also be pushed down. By increasing the thickness $h_2$ of the bottom substrate, which would increase the equivalent inductor of the RIS 22, the resonance frequency is shifted down dramatically.

Typical antennas in communication systems only have a finite ground size. When this finite ground size is large enough, the antenna performance is believed to be independent of the ground size. However, for the VSRR antenna 10 of the present invention, the required size including the ground 16 is specified and restricted instead of being of such large size.

A parameter study was performed for the ground 16 size on the un-loaded antenna. It is noted that the "infinite ground" referred here actually has a finite size of $1.2\lambda_0\times1.2\lambda_0$ (150 mm×150 mm) where $\lambda_0$ is the free space wavelength at the resonance frequency. Compared with the antenna size which is $0.112\lambda_0\times0.051\lambda_0$ (11.94 mm×5.38 mm) only, it is large enough to be considered as an infinite ground. It was found that the length of the ground $l_1$ does not affect resonance frequency very much. However, the width of the ground $w_1$ has a more perceptible influence on the resonance frequency. The basic reason is that the width affects the inductance value $L_r$ 34 of the circuit 30 indicated by FIG. 4, since the ground 16 is also one part of the loop. A narrow ground will facilitate larger inductance. Particularly, when $w_1$ is reduced to 6 mm, the resonance frequency is moved to a much lower frequency.

Figure 9:
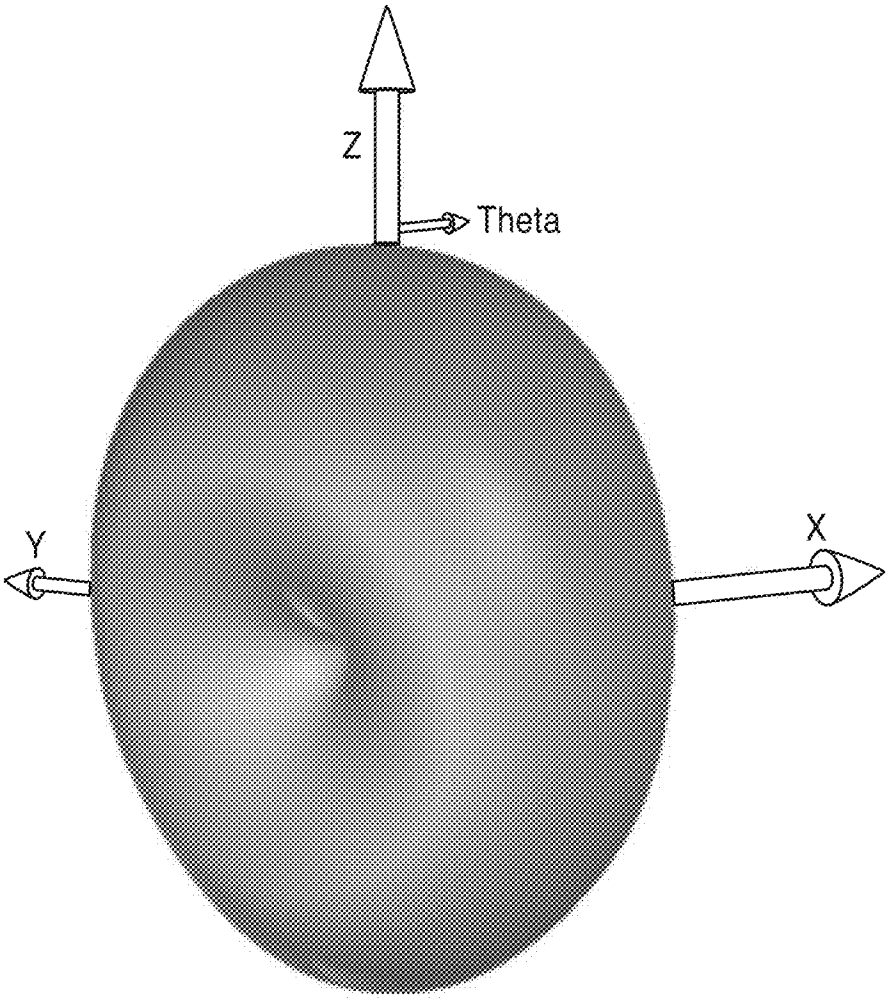
FIG. 9 illustrates a simulated 3-D radiation pattern for the inductively-fed VSRR antenna of FIG. 1.
Figure 9:
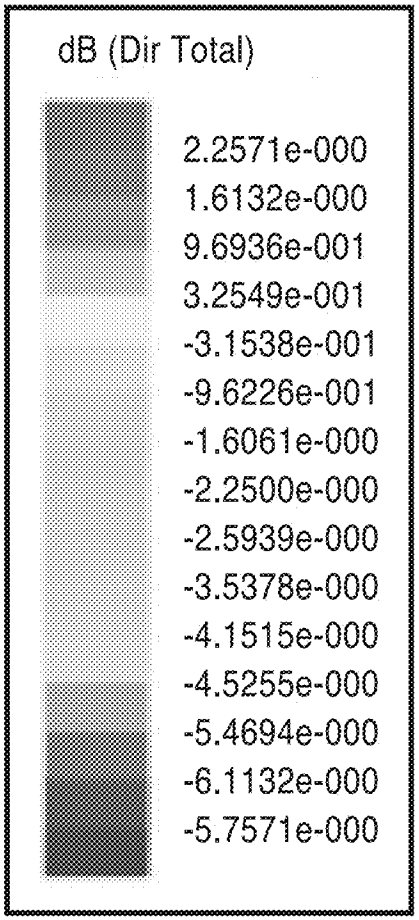

The H-plane (y-z plane) pattern was simulated, and results are shown in Table 1. For convenience, the directivity, radiation efficiency and front-to-back ratio are also shown Table 1. It is seen that the smaller the ground 16 width is, the more omni-directional the pattern becomes. For the $w_1$=6 mm case, the pattern is almost omni-directional. Also, the directivity is 2.257 dBi, which is very close to the directivity of a half-wavelength dipole (2.15 dBi). The electric field distribution was then checked at the resonance frequency. The 3-D radiation pattern is shown in FIG. 9.

Figure 10:
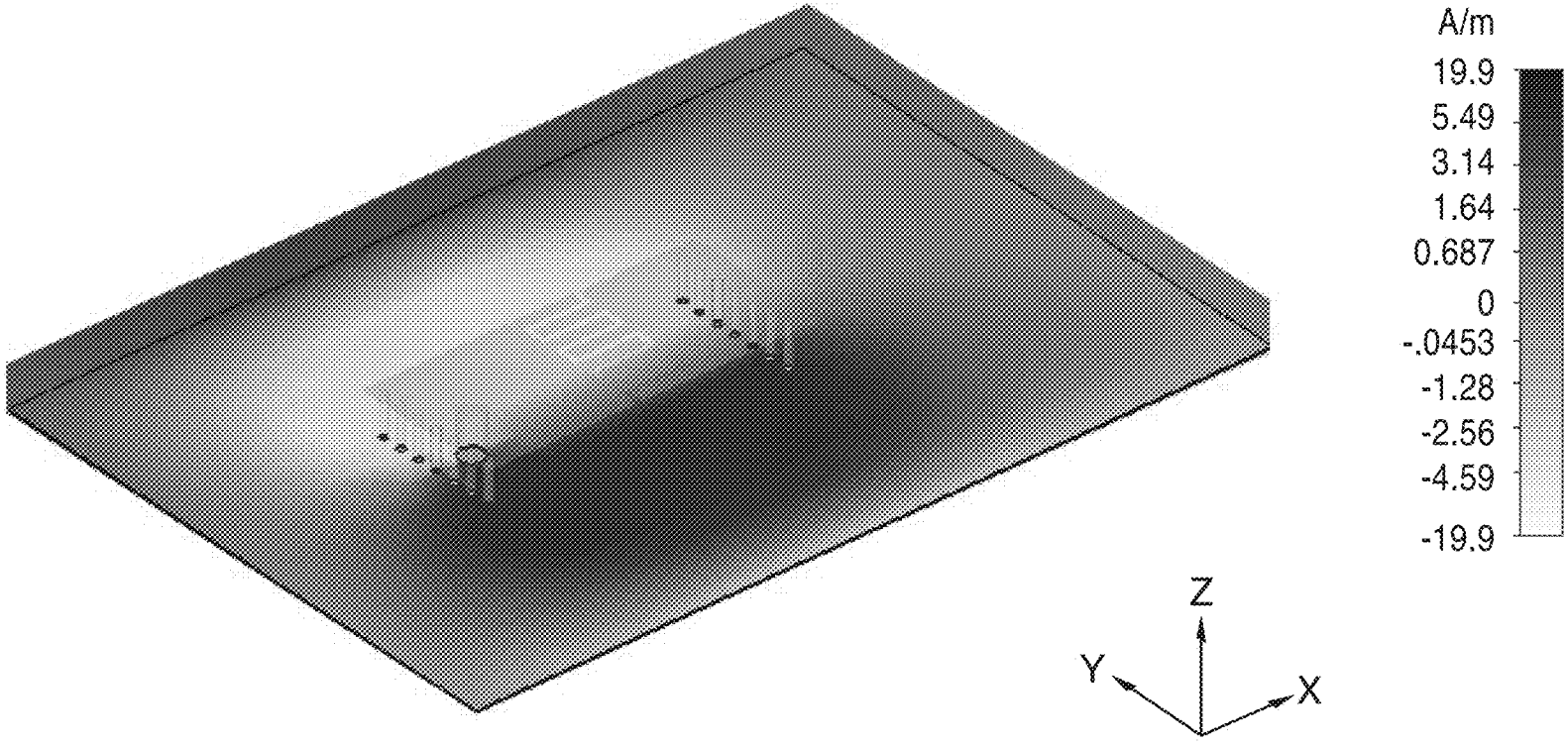
FIG. 10 illustrates a magnetic field distribution inside the x-y plane of the substrate for the inductively-fed VSRR antenna of FIG. 1.

For the $w_1$=6 mm case, the VSRR antenna 10 evolves exactly to a miniaturized electric dipole-type antenna. For the $w_1$=20 mm case, the field shows that it is still an SRR-type resonance. FIG. 10 illustrates a magnetic field distribution inside the x-y plane of the substrate for the inductively-fed VSRR antenna of FIG. 1 for the $w_1$=20 mm case. Of significant interest is that by simply changing the ground width $w_1$, a magnetic dipole-like antenna has been switched to an electric dipole-like antenna.

Figure 11:
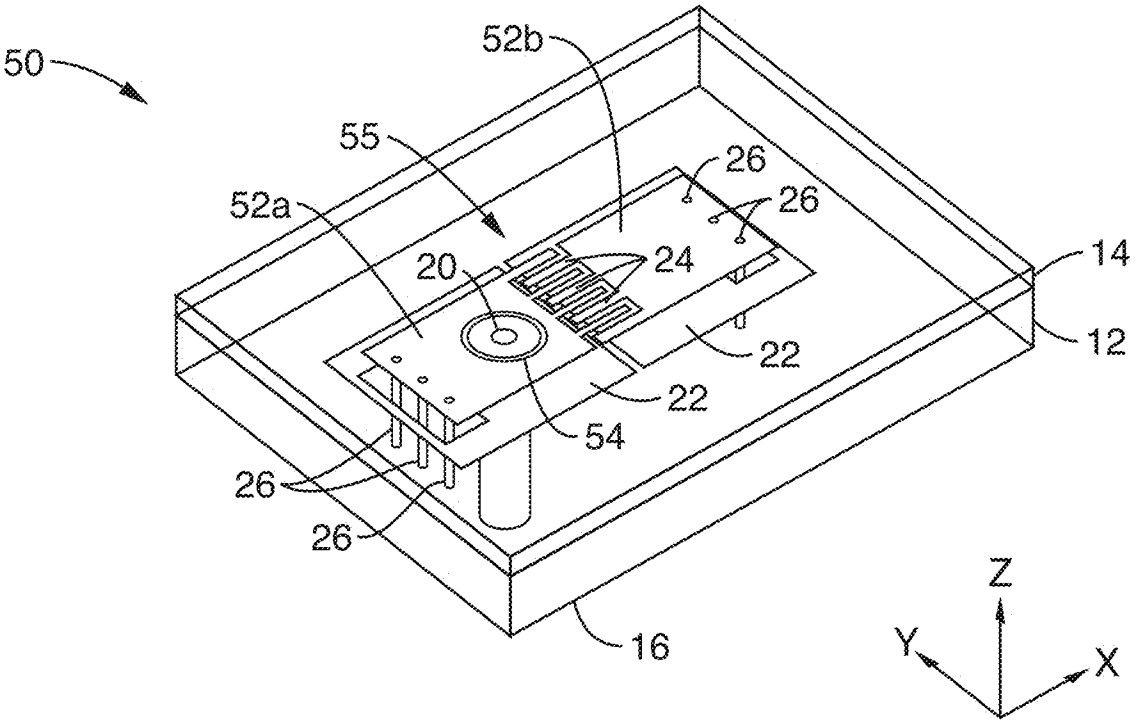
FIG. 11 shows a perspective view of the geometrical layout of a capacitively-fed Vertical Split-Ring Resonator (VSRR) antenna of the present invention.

Referring to FIG. 11, the magnetic field for the $w_1$=20 mm case was simulated at a plane inside the substrate 12 and plotted. It is clearly seen that $w_1$=20 mm case behaves as a magnetic dipole antenna over a PEC surface, whereas the $w_1$=6 mm case can be considered as a miniaturized electric dipole antenna in free space. This is considered miniaturized since its overall length $l_1$ is only $0.249\lambda_0$ at the resonance frequency, while the conventional electric dipole antenna has a length around half wavelength. It is also appreciated that when the ground 16 is sized to form an electric dipole-like antenna, the length of the ground becomes important, since it becomes one part of the current path and participates in the radiation.

The ground length $l_1$ for the $w_1$=6 mm case was varied, and the simulated reflection coefficient recorded. It was observed that the resonance frequency is dependent on $l_1$. Compared with the conventional electrical dipole antennas, this miniaturized dipole-like antenna shows some advantageous features. First, it is automatically matched to a coaxial feeding probe 20 without the need of a matching network. Second, this antenna could be miniaturized very conveniently by changing the capacitor value. For instance, if the finger 24 length $l_3$ of the interdigital capacitor 25 is varied, the resulting reflection coefficient may also be varied. This configuration may be designed to serve as a useful replacement of the traditional dipole antenna for some special compact systems.

In sum, a small ground 16 may be used to reduce the quality factor of the antenna 10 then increase the antenna bandwidth. The ground 16 also participates in the radiation, which is favorable to increase the radiation efficiency.

Traditional electrically small antennas (ESAs) usually suffer from low efficiency. Of course, the loss is dependent on the material used, and lossless materials would not impose any loss. From this point of view, air and silver are preferred, since they have less loss. But, for an integrated circuit, the circuit is usually printed on a substrate, and therefore air is difficult to apply. Silver is expensive, and thus copper is widely used.

Besides the material issue, the operating principle of the antenna is the most important factor determining the radiation efficiency. For instance, strong current should be avoided in order to reduce the conductor loss. It is helpful for the engineers to know the overall loss and its constitution.

For this purpose a loss analysis is shown in Table 2 for the inductively-fed VSRR antenna with or without the RIS. The length of the ground 16 was fixed for the first four cases: $l_1$=28.6 mm. Also the infinite ground case is just an approximation. The ground size is actually 150 mm×150 mm, which is very large compared with other cases. It behaves very close to the true infinite ground. To eliminate the influence of matching, the gain calculated here is the antenna gain itself instead of the realized gain. The efficiency for RIS loaded case is smaller, mainly due to a decreased resonance frequency. Taking the unloaded (non-RIS) antenna as an example, it is seen that overall radiation efficiency is 67.3% based on the material selected. If a substrate is used with a low loss, such as the Rogers substrate, the efficiency could be improved substantially, up to more than 90%. It is also seen that the conductor loss is not very critical compared with the dielectric loss. Overall, as an integrated ESA, this antenna provides excellent radiation efficiency.

Figure 7:
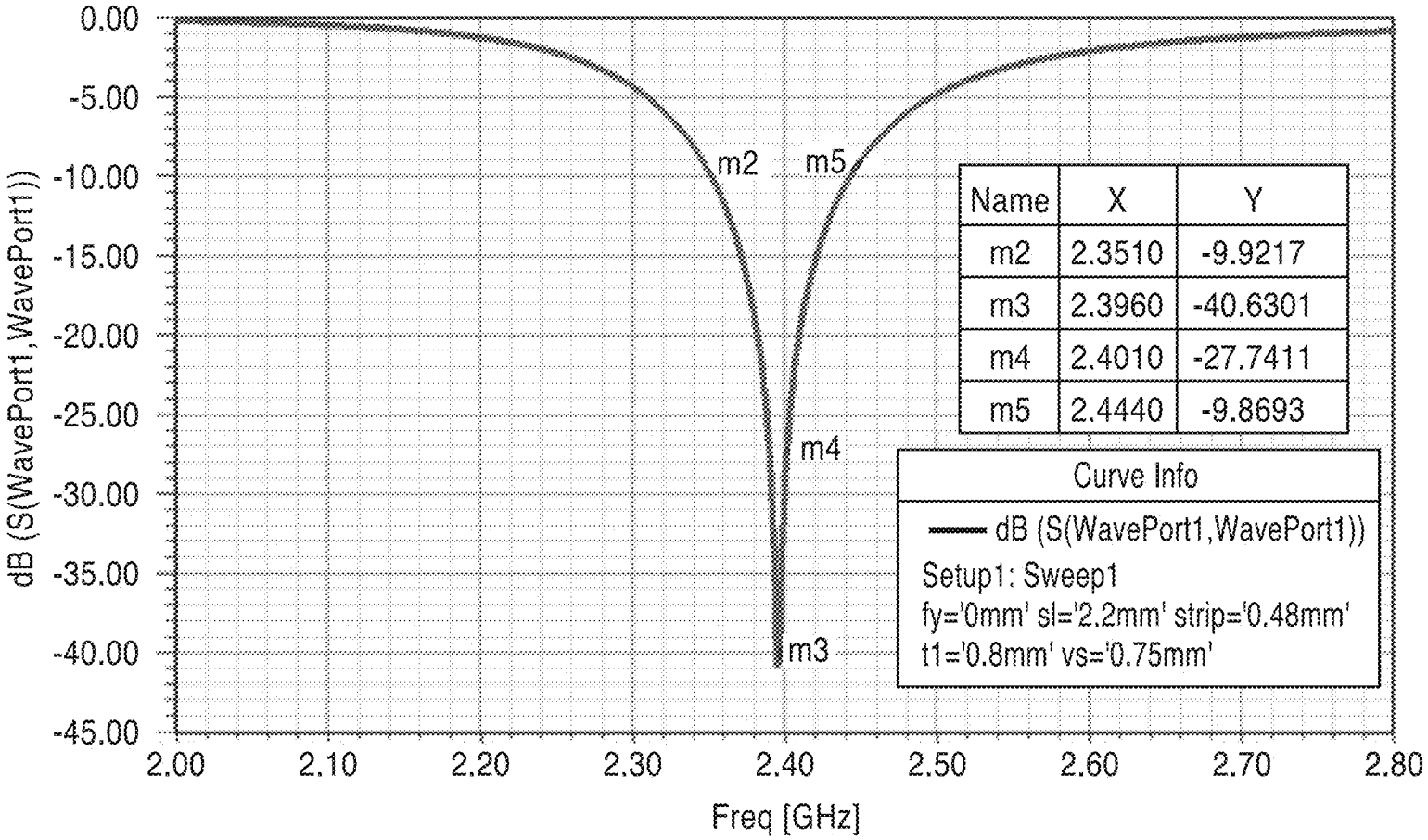
FIG. 7 shows a plot of simulated reflection coefficients for the inductively-fed VSRR antenna of FIG. 1 with RIS.
Figure 8A:
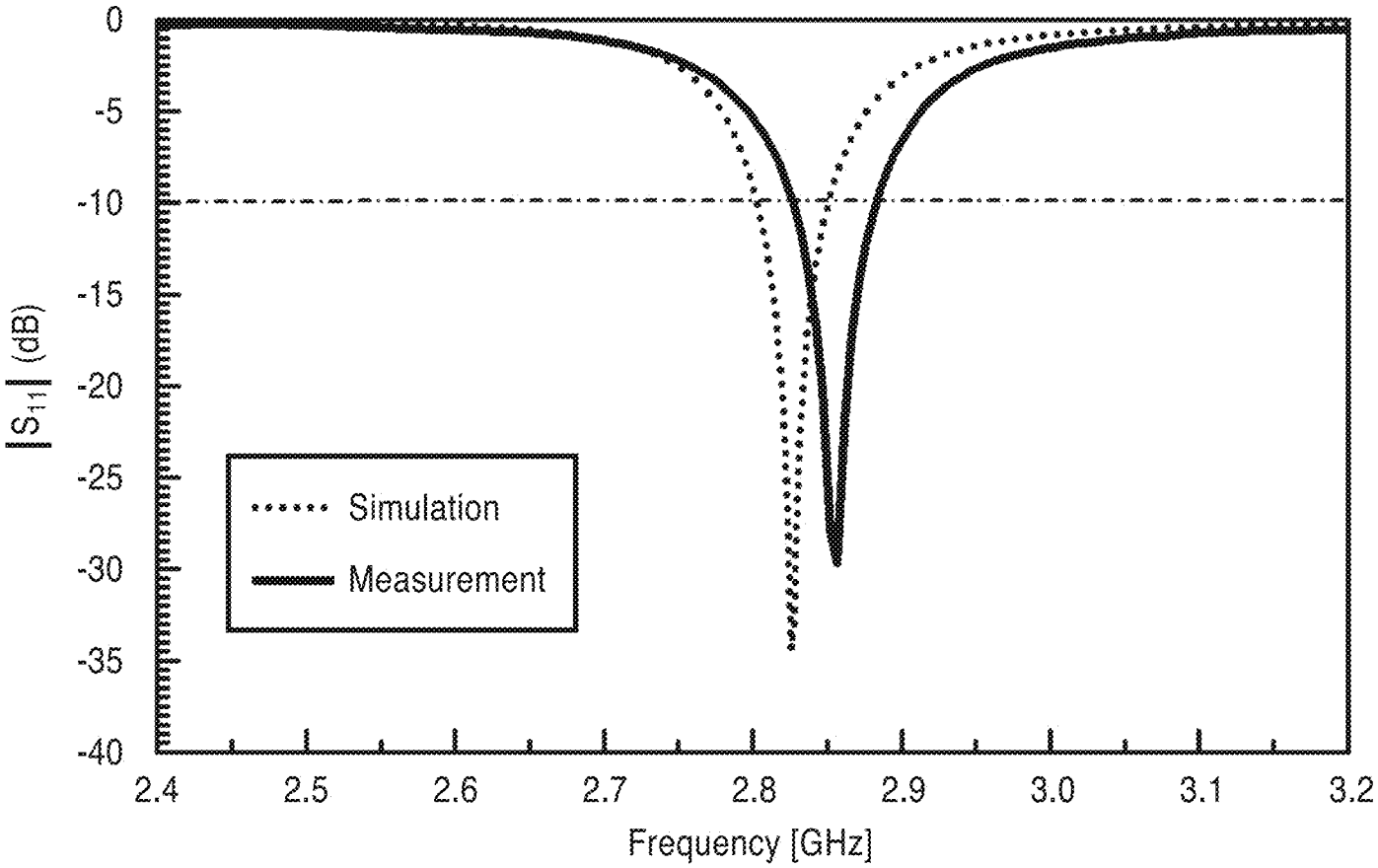
FIG. 8A shows a plot comparing simulated and measured reflection coefficients for the inductively-fed VSRR antenna of FIG. 1 with RIS.
Figure 8B:
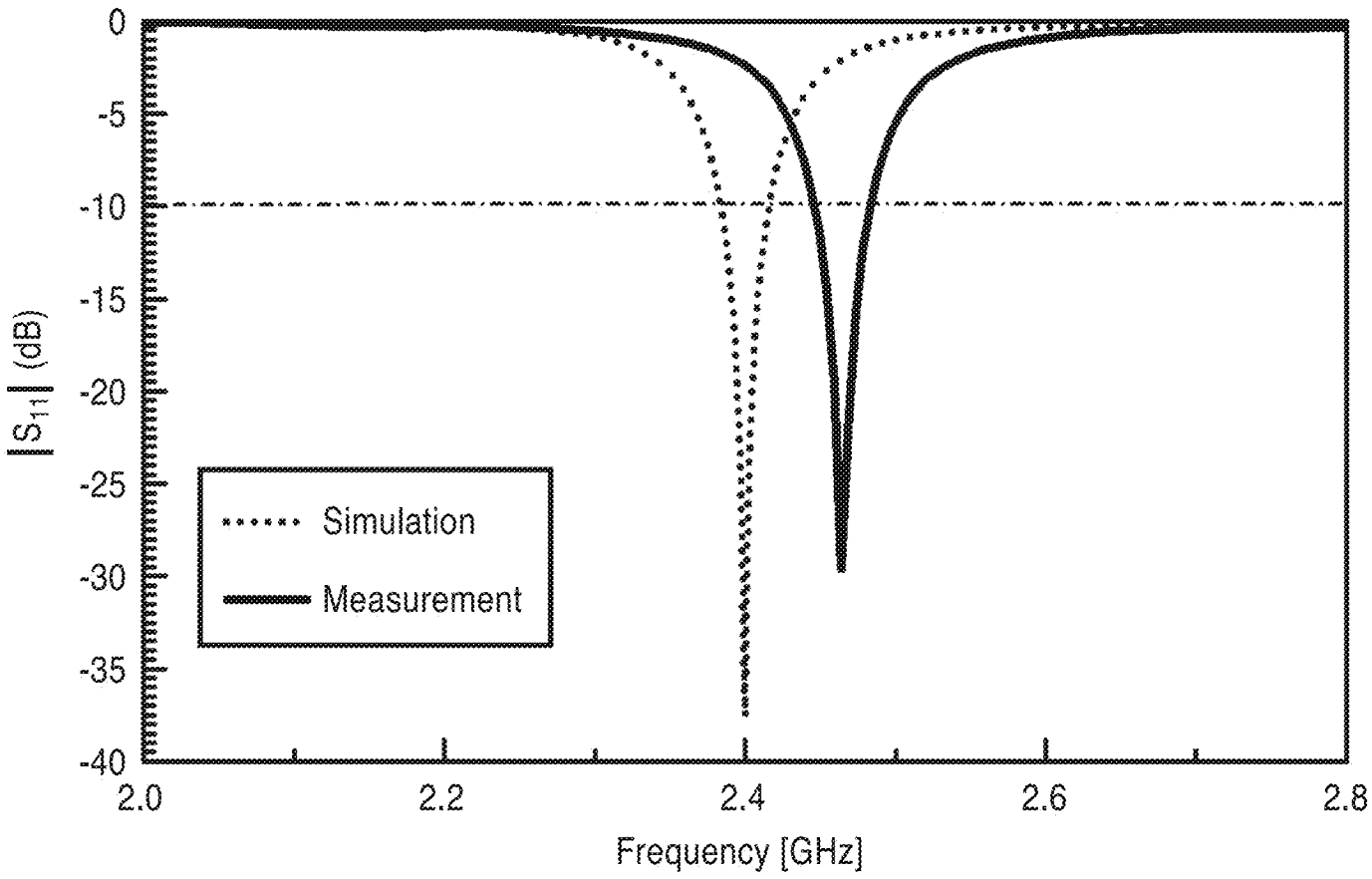
FIG. 8B shows a plot comparing simulated and measured reflection coefficients for the inductively-fed VSRR antenna of FIG. 1 without RIS.

FIG. 7 shows a plot of simulated reflection coefficients for an inductively-fed VSRR antenna with RIS 22. FIG. 8A shows a plot comparing simulated and measured reflection coefficients for an inductively-fed VSRR antenna with RIS 22. FIG. 8B shows a plot comparing simulated and measured reflection coefficients for an inductively-fed VSRR antenna without RIS 22.

In the plots of FIG. 8A and FIG. 8B, a small frequency shift is observed. To find the reason for this discrepancy, the substrate characteristics were tested, and it was found that the measured dielectric constant is reduced a little (around 3.8-3.9). The measured loss tangent of the substrate is around 0.005~0.008 (in the simulation it was set it as 0.009). Therefore the measured resonance frequency was moved up a little.

Simulations and measurements were also made for gain patterns in both E-plane and H-plane for the two antennas. Due to the up-shift of the resonance frequency and decrease of the dielectric loss tangent, the measured gain is slightly higher for both of two antennas and the front-to-back ratio is increased. It is also seen that the cross polarization level is very low.

Performance values for the inductively-fed VSRR antenna, including the electrical size, bandwidth and radiation efficiency, are shown in Table 3. And here ka indicates the electrical antenna size where k is the wave number and a is the radius of the smallest sphere enclosing the antenna. Note that for the antenna with RIS 22, ka is calculated without considering the size increase due to the RIS, since it is not the radiating element and it can be miniaturized. (If the RIS is included, ka=0.47). The simulated and measured gain is the realized gain which has taken the mis-matching into account. With respect to the results, both antennas are electrically small according to the criterion ka<1. Basically, the measured results are in agreement with the simulation and the antennas show promising performance.

Figure 12:
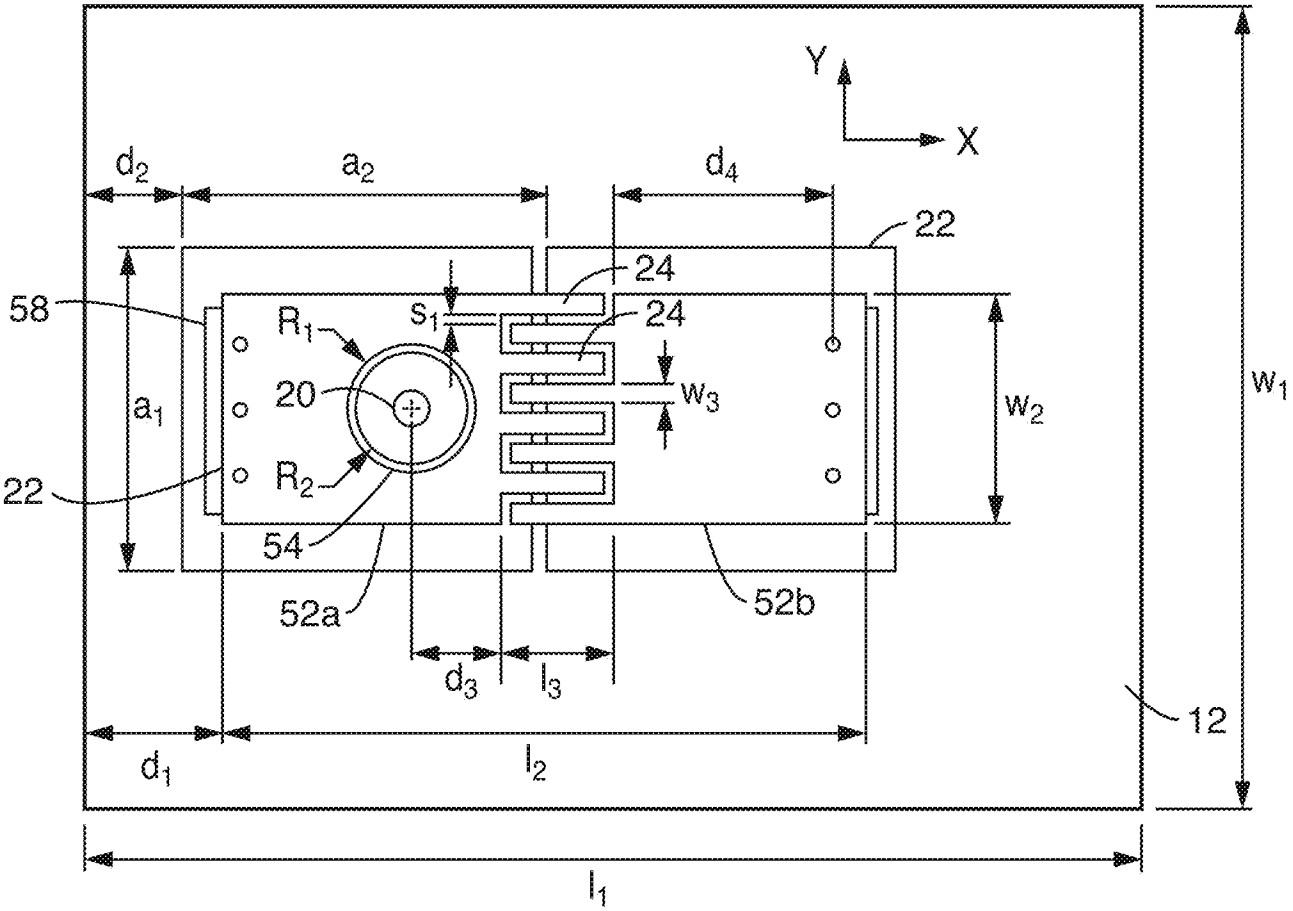
FIG. 12 shows a plan view of the geometrical layout, with dimensions, of the capacitively-fed VSRR antenna of FIG. 11.

FIG. 11 shows a perspective view of the geometrical layout of a capacitively-fed Vertical Split-Ring Resonator (VSRR) antenna 50 of the present invention. FIG. 12 shows a plan view of the geometrical layout, with dimensions, of the capacitively-fed VSRR antenna 50 of FIG. 11. Compared with the previous antennas, the coaxial feeding probe 20 is capacitively coupled to the VSRR surface 52*a*, which is achieved by cutting a circular ring slot 54 between probe position 20 and the top surface 52*a*. As with the inductively fed antenna 10, the capacitively-fed antenna comprises a VSRR with interdigitated capacitor 55 comprising first and second planar segments 52*a* and 52*b* with matching interdigitating fingers 24.

Similarly, the antenna 50 may be loaded with or without the RIS patches 22. To improve matching, only three metallic vias 26 are to connect the ground 16 and top surface 14 that are separated by substrate 12. Several parameters may be used to optimize the matching: the probe 20 positioning along x axis, the size and width of the ring slot 54, and the vias 26. The substrate material 12 used here is generally same as the previous antenna 10 of FIGS. 1-3.

Figure 13:
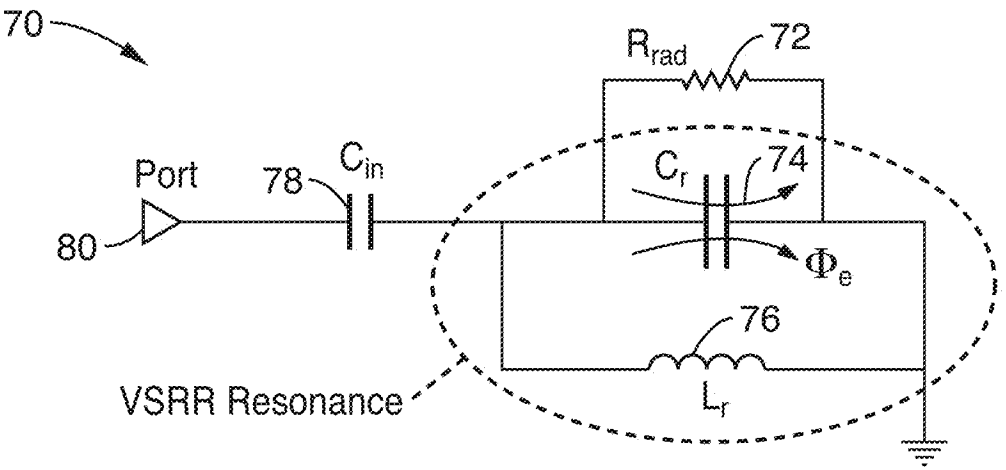
FIG. 13 shows a schematic diagram of a representative circuit model of the capacitively-fed VSRR antenna of FIG. 11.

FIG. 13 shows a schematic diagram of a representative equivalent circuit model 70 of the capacitively-fed VSRR antenna 50 of FIG. 11. The circuit 70 is similar to the circuit model 30 shown in FIG. 4, except for the coupling capacitor $C_{in}$ 78 generated from the coupling between the probe 20 (from port 80) and VSRR 50. The VSRR 50 is still modeled as a parallel LC resonator having a radiation resistor ($R_{rad}$) 72 associated with a combination of the components and the capacitor $C_r$ 74 associated with the interdigitated capacitor 55. Inductor $L_r$ 76 is representative of inductance generated from loop metal vias 26 and ground 16. The antenna circuit 70 is excited by applying a voltage difference on the capacitor $C_r$ 74. Due to the capacitive input coupling 78, the reactance for the antenna 50 mainly negative and close to zero at its resonance frequency.

Capacitively-fed VSRR antennas, with and without RIS 22, were fabricated and tested with the standard PCB process. Referring back to FIG. 12, the geometrical parameters for the unloaded (non RIS 22) case were: $a_1$=9.0 mm, $a_2$=9.15 mm, $R_1$=1.63 mm, $R_2$=1.5 mm, $s_1$=0.23 mm, $l_1$=27.8 mm, $w_1$=20 mm, $l_2$=13.43 mm, $w_2$=5.77 mm, $l_3$=2.83 mm, $w_3$=0.52 mm, $d_1$=5.47 mm, $d_3$=1.95 mm and $d_4$=5.5 mm. The three vias 26 on each of the two ends 52*a* and 52*b* have a radius of 0.15 mm and a spacing of 2 mm. For the loaded (including RIS 22) case: $l_2$=16.03 mm, $w_2$=5.77 mm, $l_1$=26.5 mm, $w_1$=20 mm, $a_1$=9.0 mm, and $a_2$=9.15 mm. For the embodiment including RIS 22, cutout 58 may be used to allow clearance for the vias 26.

The simulated and measured reflection coefficients were obtained. Due to the shift of dielectric constant, the resonance frequency for the capacitively-fed VSRR antenna also moves up, which is similar to the antennas modeled after antenna 10 (see FIG. 8A and FIG. 8B). The radiation patterns, and simulated and measured gain and efficiency for the antennas were obtained. Good agreement is observed. Low cross polarization is achieved. Table 4 shows the summarized the antenna characteristics, including the fractional bandwidth, gain and radiation efficiency. The measured gain is higher than the simulated data, which is also due to the decrease of the material loss tangent and the rise of resonance frequency. By loading the RIS 22, it is seen that the resonance frequency has been pushed down considerably, and ka is changed from 0.397 to 0.347, while the measured radiation efficiency is also reduced from 45.0% to 22.5%. It is seen that for these ESAs, size reduction could substantially deteriorate the radiation efficiency. Compared with Table 2 and 3, it is found that the inductively-fed antennas provide a relatively better radiation performance than the capacitively-fed antennas.

Figure 14:
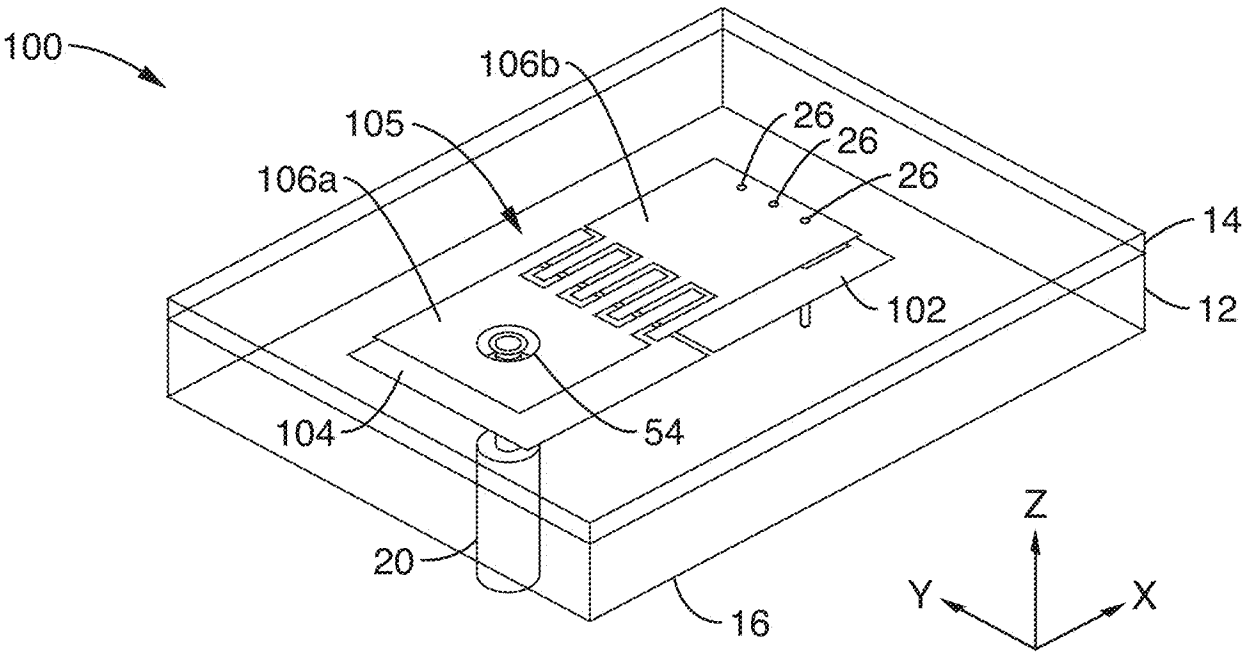
FIG. 14 shows a perspective view of the geometrical layout of an asymmetric capacitively-fed Vertical Split-Ring Resonator (VSRR) antenna of the present invention.

FIG. 14 shows a perspective view of an asymmetric capacitively-fed Vertical Split-Ring Resonator (VSRR) antenna 100 of the present invention. The coaxial feeding probe 20 is capacitively coupled to the VSRR surface 106*a*, which is achieved by cutting a circular ring slot 54 between probe position 20 and the top surface 106*a*. The capacitively-fed antenna 100 comprises a VSRR with interdigitated capacitor 105 comprising first and second planar segments 106*a* and 106*b* with matching interdigitating fingers 24. A similar substrate to previously shown embodiments is used, with lower substrate layer 12, upper substrate layer 14, and ground 16. Similarly, the antenna 100 may be loaded with or without the RIS patches 102, 104. The vias 26 on the first side 106*a* are removed (leaving only three vias on side 106*b*), and thus the coaxial feeding probe 20 becomes part of the current loop.

Figure 15:
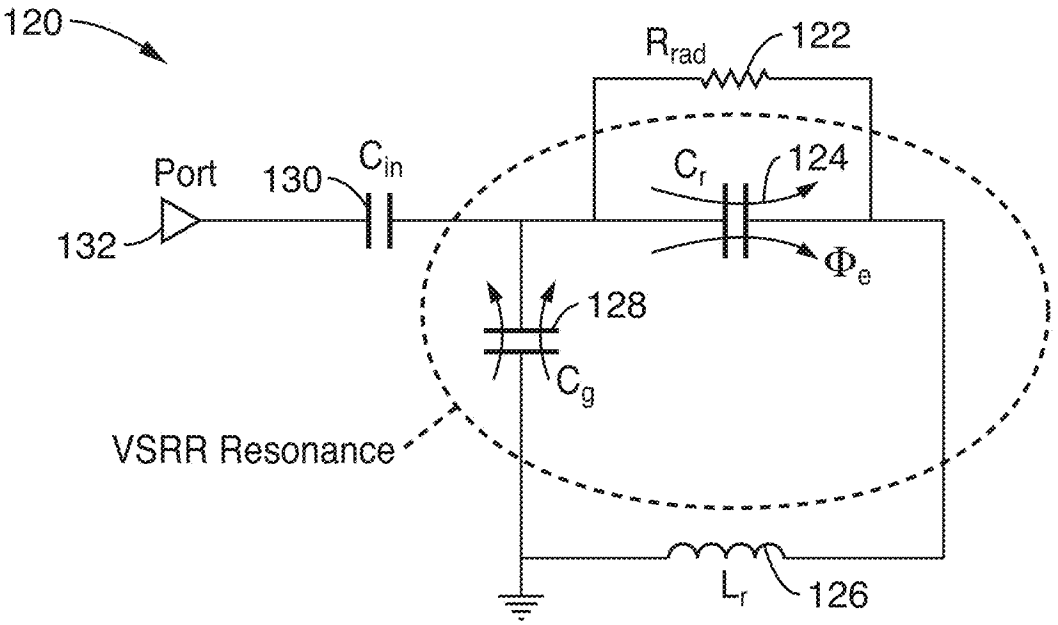
FIG. 15 shows a schematic diagram of a representative circuit model of the asymmetric capacitively-fed VSRR antenna of FIG. 14.

FIG. 15 shows a schematic diagram of a representative circuit model 120 of the asymmetric capacitively-fed VSRR antenna 100 of FIG. 14. Circuit model 120 includes a radiation resistor ($R_{rad}$) 122 associated with a combination of the components and the capacitor $C_r$ 124 associated with the interdigitated capacitor 105. Inductor $L_r$ 126 is representative of inductance generated from loop metal vias 26 and ground 16. Since one side is open, the wave may radiate away from this open boundary. Note circuit 120 is just a simplified approximation, which is used to roughly explain the working principle. In fact, a small radiation resistor should also be applied parallel to the capacitor $C_g$ 128. The capacitor $C_{in}$ 130 represents the capacitive coupling between the probe 20 and the top surface 106*a*. It should be pointed out that since the total capacitance of the VSRR is reduced due to the series connection of $C_r$ 124 and $C_g$ 128 the resonance frequency is higher compared with the previous two embodiments. In other words, their electrical size is larger. Furthermore, due to the edge radiation, the main beam direction may be shifted from the Z-direction leading to an asymmetric beam pattern in E-plane.

Asymmetric capacitively-fed VSRR antennas, with and without RIS 22, were fabricated and tested with the standard PCB process. With RIS loading, it was seen that the resonance frequency was pushed down from 2.764 GHz to 2.44 GHz due to the RIS loading. The reactance was mainly negative because of the capacitive coupling, and approaches zero at the two matching points. Note that the matching can also be easily obtained by changing the probe 20 position and the ring slot 54 size or width.

The geometrical parameters for the tested asymmetric capacitively-fed VSRR antennas are: $a_1$=9.0 mm, $a_2$=9.15 mm, $R_1$=1.1 mm, $R_2$=0.7 mm, $s_1$=0.23 mm, $l_1$=26.5 mm, $w_1$=20 mm, $l_2$=16.33 mm, $w_2$=6.89 mm, $w_3$=0.66 mm, $l_3$=3.73 mm, $d_1$=3.22 mm, $d_2$=2.35 mm, $d_3$=3.4 mm, and $d_4$=5.5 mm. There three vias 26 on end 106*b* had a radius of 0.15 mm and a spacing of 1.5 mm.

The simulated and measured reflection coefficients were obtained, and show are well matched results, with a small frequency shift is due to the change of the dielectric constant. Simulated and measured gain patterns were also obtained. It was found that the main beam direction in E-plane is shifted away from the broadside due to the open boundary or the unsymmetrical configuration. Accordingly, the configuration of antenna 100 may be useful for some special pattern diversity antenna systems.

The radiation performance for the asymmetric capacitively-fed VSRR antennas is shown in Table 5. The measured radiation efficiency is 52% for the un-loaded case and 38.9% for the loaded case. A small discrepancy between simulation and measurement values may also come from the change of the loss tangent of the material. Comparing Table 5 with Tables 2, 3, and 4, it was found that the inductively-fed antennas have the best performance in terms of both the radiation efficiency and bandwidth.

In sum, the inductively-fed VSRR antennas have the best performance. Essentially the metamaterial-inspired antennas of the present invention behave similarly to the magnetic dipole antennas over a PEC surface. A miniaturized electric dipole-type antenna is also achieved by changing the ground size which shows some advantageous features such as the self-matching capability and small size. Despite that a relatively lossy substrate is used, these electrically small antennas are still able to provide a good efficiency up to 68%. They are low-cost, compact, and may readily be applied in the 2.4 GHz wireless LAN system, and may be readily scaled up or down and applied in other communication systems. For example, the VSRR antennas of the present invention may be scaled and adapted in lower or upper frequency ranges, such as for the UHF RFID applications.

From the discussion above it will be appreciated that the invention can be embodied in various ways, including the following:

1. An antenna, comprising: a substrate having an upper surface and a lower surface; and an interdigitated capacitor coupled to the upper surface of the substrate; the interdigitated capacitor comprising a first planar segment and a second planar segment; the first planar segment and second planar segment comprising one or more interdigitated fingers that are separated by a gap disposed between the first planar segment and second planar segment; wherein the interdigitated capacitor is coupled to the substrate to function as a vertical split ring resonator.

2. The antenna of any of the preceding embodiments, wherein the antenna functions as a vertical high-Q LC resonator with a parallel radiation resistance.

3. The antenna of any of the preceding embodiments: wherein the antenna is configured to radiate energy in a vertical orientation with respect to the substrate; and wherein said radiated energy is emitted in an omni-directional radiation pattern.

4. The antenna of any of the preceding embodiments: wherein the substrate comprises a PEC-backed dielectric substrate; and wherein the antenna functions as a magnetic dipole antenna over a PEC surface of the substrate.

5. The antenna of any of the preceding embodiments, wherein the antenna comprises an electrically small substantially planar structure having a maximum dimension of less than approximately 12 mm.

6. The antenna of any of the preceding embodiments, further comprising: a ground; and a plurality of vias coupling the top surface of the substrate to the ground.

7. The antenna of any of the preceding embodiments, wherein the plurality of vias are electrically coupled to both the first planar segment and second planar segment of the interdigitated capacitor such that the antenna functions as an open loop structure.

8. The antenna of any of the preceding embodiments, wherein the ground is sized such that the antenna functions as a miniaturized electric dipole antenna in free space 9. The antenna of any of the preceding embodiments: wherein the antenna comprises a reactive inductive surface (RIS) disposed under the upper surface of the substrate; and wherein the RIS is configured to reduce the resonance frequency of the antenna.

10. The antenna of any of the preceding embodiments, further comprising a feeding probe coupled to the interdigitated capacitor.

11. The antenna of any of the preceding embodiments, wherein the feeding probe comprises a coaxial feeding probe.

12. The antenna of any of the preceding embodiments, wherein the split ring resonator is automatically matched to the feeding probe without the need for a matching network.

13. The antenna of any of the preceding embodiments, wherein the feeding probe is inductively coupled to the interdigitated capacitor.

14. The antenna of any of the preceding embodiments, wherein the feeding probe is capacitively coupled to the interdigitated capacitor.

15. The antenna of any of the preceding embodiments, wherein the feeding probe is electrically coupled to the first planar segment and the vias are coupled to the second planar segment to form an asymmetric capacitive split ring resonator.

16. An apparatus configured for radiating energy, comprising: a substrate having an upper surface and a lower surface; and a capacitor coupled to the upper surface of the substrate; the capacitor comprising a first planar segment separated by a gap from a second planar segment; wherein the capacitor is coupled to the substrate to function as a vertical split ring resonator; and wherein the vertical split ring resonator is configured to radiate energy in a vertical orientation with respect to the substrate.

17. The apparatus of any of the preceding embodiments 16: the first planar segment and second planar segment comprising one or more interdigitated fingers that are separated by the gap to form an interdigitated capacitor.

18. The apparatus of any of the preceding embodiments, wherein the vertical split ring resonator functions as a high-Q LC resonator with a parallel radiation resistance.

19. The apparatus of any of the preceding embodiments, wherein the split ring resonator is configured to radiate energy with an omni-directional radiation pattern.

20. The apparatus of any of the preceding embodiments: wherein the substrate comprises a PEC-backed dielectric substrate; and wherein the apparatus functions as a magnetic dipole antenna over a PEC surface of the substrate.

21. The apparatus of any of the preceding embodiments, wherein the apparatus comprises an electrically small, substantially planar structure having a maximum dimension of less than approximately 12 mm.

22. The apparatus of any of the preceding embodiments, further comprising: a ground; and a plurality of vias coupling the top surface of the substrate to the ground.

23. The apparatus of any of the preceding embodiments, wherein the plurality of vias are electrically coupled to both the first planar segment and second planar segment of the interdigitated capacitor such that the apparatus functions as an open loop structure.

24. The apparatus of any of the preceding embodiments, wherein the ground is sized such that the apparatus functions as a miniaturized electric dipole antenna in free space 25. The apparatus of any of the preceding embodiments, further comprising a reactive inductive surface (RIS) disposed under the upper surface of the substrate; wherein the RIS is configured to reduce the resonance frequency of the apparatus.

26. The apparatus of any of the preceding embodiments, further comprising a feeding probe coupled to the interdigitated capacitor.

27. The apparatus of any of the preceding embodiments, wherein the feeding probe comprises a coaxial feeding probe.

28. The apparatus of any of the preceding embodiments, wherein the split ring resonator is automatically matched to the feeding probe without the need for a matching network.

29. The apparatus of any of the preceding embodiments, wherein the feeding probe is inductively coupled to the interdigitated capacitor.

30. The apparatus of any of the preceding embodiments, wherein the feeding probe is capacitively coupled to the interdigitated capacitor.

31. The apparatus of any of the preceding embodiments, wherein the feeding probe is electrically coupled to the first planar segment and the vias are coupled to the second planar segment to form an asymmetric capacitive split ring resonator.

32. A method for radiating energy, comprising: a substrate having an upper surface and a lower surface; coupling a capacitor the upper surface of the substrate having upper and lower surfaces; the capacitor comprising a first planar segment separated by a gap from a second planar segment; wherein the capacitor is coupled to the substrate to function as a vertical split ring resonator; and applying a voltage across the capacitor to generate a magnetic field; wherein the vertical split ring resonator radiates energy in association with the magnetic field in a vertical orientation with respect to the substrate.

33. The method of any of the preceding embodiments: the first planar segment and second planar segment comprising one or more interdigitated fingers that are separated by the gap to form an interdigitated capacitor.

34. The method of any of the preceding embodiments, wherein the split ring resonator radiates energy with an omni-directional radiation pattern.

35. The method of any of the preceding embodiments: wherein the substrate comprises a PEC-backed dielectric substrate; and wherein the radiated energy is emitted to form a magnetic dipole antenna over a PEC surface of the substrate.

36. The method of any of the preceding embodiments, further comprising: coupling a ground to the lower surface of the substrate and a plurality of vias to the top surface of the substrate and the ground.

37. The method of any of the preceding embodiments, wherein the plurality of vias are electrically coupled to both the first planar segment and second planar segment of the interdigitated capacitor such that the vertical split ring resonator radiates energy as an open loop structure.

38. The method of any of the preceding embodiments, wherein the ground is sized such that the radiated energy is emitted to form a miniaturized electric dipole antenna in free space 39. The method of any of the preceding embodiments, further comprising: coupling a reactive inductive surface (RIS) under the upper surface of the substrate; wherein the RIS reduces the resonance frequency of the vertical split ring resonator.

40. The method of any of the preceding embodiments, further comprising: coupling a feeding probe to the interdigitated capacitor.

41. The method of any of the preceding embodiments, automatically matching the split ring resonator to the feeding probe without the need for a matching network.

42. The method of any of the preceding embodiments, wherein the feeding probe is asymmetrically and capacitively coupled to the interdigitated capacitor, the method further comprising: shifting a main beam direction of the radiated energy to emit an asymmetric beam pattern.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

TABLE 1

| Ground Width | $f_0$ (GHZ) | D (dBi) | Effi. | Front-to-Back Ratio (dB) |
|---|---|---|---|---|
| 6 mm | 2.612 | 2.257 | 71.3% | 0.875 |
| 16 mm | 2.808 | 3.175 | 69.6% | 2.321 |
| 20 mm | 2.827 | 3.559 | 67.3% | 2.928 |
| 26 mm | 2.840 | 3.969 | 63.2% | 3.29 |
| → + ∞ | 2.857 | 6.232 | 50.5% | 13.54 |

TABLE 2

| | Without RIS (at 2.83 GHz) | | | With RIS (at 2.4 GHz) | | |
|---|---|---|---|---|---|---|
| | Directivity | Gain | Efficiency | Directivity | Gain | Efficiency |
| Lossy with $\epsilon_r = 0.009$ | 3.559 | 1.84 | 67.3% | 3.0152 | −0.512 | 44.4% |
| Lossy but with $\epsilon_r = 0.001$ | 3.608 | 3.194 | 90.9% | 3.073 | 1.946 | 77.14% |
| Cond. Loss Only | 3.603 | 3.394 | 95.3% | 3.106 | 2.456 | 86.1% |
| Lossless | 3.582 | 3.582 | 100% | 3.131 | 3.131 | 100% |

TABLE 3

| | Without RIS | With RIS |
|---|---|---|
| Sim. $f_0$/ka | 2.83 GHz/0.427 | 2.4 GHz/0.362 |
| Sim. FBW (−10 dB) | 1.75% | 1.38% |
| Meas. FBW (−10 dB) | 2.1% | 1.58% |
| Sim. Peak Gain | 1.823 dBi | −0.671 dBi |
| Sim. Directivity | 3.559 dBi | 3.015 dBi |
| Sim. Efficiency | 67.1% | 42.8% |
| Meas. Gain | 2.05 dBi | 0.47 dBi |
| Meas. Efficiency | 68.1% | 48.9% |

TABLE 4

| | Without RIS | With RIS |
|---|---|---|
| Sim. $f_0$/ka | 2.396 GHz/0.397 | 1.833 GHz/0.347 |
| Sim. FBW (−10 dB) | 1.21% | 0.98% |
| Meas. FBW (−10 dB) | 1.22% | 1.10% |
| Sim. Peak Gain | −0.535 dBi | −4.93 dBi |
| Sim. Directivity | 3.027 dBi | 2.508 dBi |
| Sim. Efficiency | 44.04% | 18.04% |
| Meas. Gain | −0.4 dBi | −3.86 dBi |
| Meas. Efficiency | 45.0% | 22.5% |

TABLE 5

| | Without RIS | With RIS |
|---|---|---|
| Sim. $f_0$/ka | 2.764 GHz/0.541 | 2.44 GHz/0.478 |
| Sim. FBW (−10 dB) | 1.52% | 1.44% |

TABLE 5-continued

| | Without RIS | With RIS |
|---|---|---|
| Meas. FBW (−10 dB) | 1.72% | 1.74% |
| Sim. Peak Gain | 0.246 dBi | −2.066 dBi |
| Sim. Directivity | 3.15 dBi | 2.355 dBi |
| Sim. Efficiency | 51.2% | 36.13% |
| Meas. Gain | 0.49 dBi | −1.66 dBi |
| Meas. Efficiency | 52.0% | 38.9% |

What is claimed is:

1. An antenna, comprising:

a substrate having an upper surface and a lower surface; and an interdigitated capacitor coupled to the upper surface of the substrate; the interdigitated capacitor comprising a first planar segment and a second planar segment; the first planar segment and second planar segment comprising one or more interdigitated fingers that are separated by a gap disposed between the first planar segment and second planar segment; wherein the interdigitated capacitor is coupled to the substrate to function as a vertical split ring resonator;

a around; and a plurality of vias coupling the top surface of the substrate to the ground; wherein the plurality of vias are electrically coupled to both the first planar segment and second planar segment of the interdigitated capacitor such that the antenna functions as an open loop structure.

2. The antenna as recited in claim 1, wherein the antenna functions as a vertical high-Q LC resonator with a parallel radiation resistance.

3. The antenna as recited in claim 1: wherein the antenna is configured to radiate energy in a vertical orientation with respect to the substrate; and wherein said radiated energy is emitted in an omni-directional radiation pattern.

4. The antenna as recited in claim 1: wherein the substrate comprises a perfect electric conductor (PEC) backed dielectric substrate; and wherein the antenna functions as a magnetic dipole antenna over a PEC surface of the substrate.

5. The antenna as recited in claim 1, wherein the antenna comprises an electrically small substantially planar structure having a maximum dimension of less than approximately 12 mm.

6. The antenna as recited in claim 1, wherein the ground is sized such that the antenna functions as a miniaturized electric dipole antenna in free space.

7. The antenna as recited in claim 1:

wherein the antenna comprises a reactive inductive surface (RIS) disposed under the upper surface of the substrate; and wherein the RIS is configured to reduce the resonance frequency of the antenna.

8. The antenna as recited in claim 1, further comprising a feeding probe coupled to the interdigitated capacitor.

9. The antenna as recited in claim 8, wherein the feeding probe comprises a coaxial feeding probe.

10. The antenna as recited in claim 8, wherein the split ring resonator is automatically matched to the feeding probe without the need for a matching network.

11. The antenna as recited in claim 8, wherein the feeding probe is inductively coupled to the interdigitated capacitor.

12. The antenna as recited in claim 8, wherein the feeding probe is capacitively coupled to the interdigitated capacitor.

13. The antenna as recited in claim 12, wherein the feeding probe is electrically coupled to the first planar segment and the vias are coupled to the second planar segment to form an asymmetric capacitive split ring resonator.

14. The apparatus configured for radiating energy, comprising:

a substrate having an upper surface and a lower surface; and a capacitor coupled to the upper surface of the substrate; the capacitor comprising a first planar segment separated by a gap from a second planar segment; wherein the capacitor is coupled to the substrate to function as a vertical split ring resonator; and wherein the vertical split ring resonator is configured to radiate energy in a vertical orientation with respect to the substrate; the first planar segment and second planar segment comprising one or more interdigitated fingers that are separated by the gap to form an interdigitated capacitor;

a ground; and a plurality of vias coupling the top surface of the substrate to the ground;

wherein the plurality of vias are electrically coupled to both the first planar segment and second planar segment of the interdigitated capacitor such that the apparatus functions as an open loop structure.

15. The apparatus as recited in claim 14, wherein the vertical split ring resonator functions as a high-Q LC resonator with a parallel radiation resistance.

16. The apparatus as recited in claim 14, wherein the split ring resonator is configured to radiate energy with an omni-directional radiation pattern.

17. The apparatus as recited in claim 14: wherein the substrate comprises a perfect electric conductor (PEC) backed dielectric substrate; and wherein the apparatus functions as a magnetic dipole antenna over a PEC surface of the substrate.

18. The apparatus as recited in claim 14, wherein the apparatus comprises an electrically small, substantially planar structure having a maximum dimension of less than approximately 12 mm.

19. The apparatus as recited in claim 14, wherein the ground is sized such that the apparatus functions as a miniaturized electric dipole antenna in free space.

20. The apparatus as recited in claim 14, further comprising a reactive inductive surface (RIS) disposed under the upper surface of the substrate;

wherein the RIS is configured to reduce the resonance frequency of the apparatus.

21. The apparatus as recited in claim 14, further comprising a feeding probe coupled to the interdigitated capacitor.

22. The apparatus as recited in claim 21, wherein the feeding probe comprises a coaxial feeding probe.

23. The apparatus as recited in claim 21, wherein the split ring resonator is automatically matched to the feeding probe without the need for a matching network.

24. The apparatus as recited in claim 21, wherein the feeding probe is inductively coupled to the interdigitated capacitor.

25. The apparatus as recited in claim 21, wherein the feeding probe is capacitively coupled to the interdigitated capacitor.

26. The apparatus as recited in claim 25, wherein the feeding probe is electrically coupled to the first planar segment and the vias are coupled to the second planar segment to form an asymmetric capacitive split ring resonator.

27. A method for radiating energy, comprising: a substrate having an upper surface and a lower surface;

coupling a capacitor the upper surface of the substrate having upper and lower surfaces;

the capacitor comprising a first planar segment separated by a gap from a second planar segment;

wherein the capacitor is coupled to the substrate to function as a vertical split ring resonator; and applying a voltage across the capacitor to generate a magnetic field;

wherein the vertical split ring resonator radiates energy in association with the magnetic field in a vertical orientation with respect to the substrate;

the first planar segment and second planar segment comprising one or more interdigitated fingers that are separated by the gap to form an interdigitated capacitor;

coupling a ground to the lower surface of the substrate and a plurality of vias to the top surface of the substrate and the ground;

wherein the plurality of vias are electrically coupled to both the first planar segment and second planar segment of the interdigitated capacitor such that the vertical split ring resonator radiates energy as an open loop structure.

28. The method as recited in claim 27, wherein the split ring resonator radiates energy with an omni-directional radiation pattern.

29. The method as recited in claim 27: wherein the substrate comprises a perfect electric conductor (PEC) backed dielectric substrate; and wherein the radiated energy is emitted to form a magnetic dipole antenna over a PEC surface of the substrate.

30. The method as recited in claim 27, wherein the ground is sized such that the radiated energy is emitted to form a miniaturized electric dipole antenna in free space.

31. The method as recited in claim 27, further comprising:

coupling a reactive inductive surface (RIS) under the upper surface of the substrate;

wherein the RIS reduces the resonance frequency of the vertical split ring resonator.

32. The method as recited in claim 27, further comprising: coupling a feeding probe to the interdigitated capacitor.

33. The method as recited in claim 32, automatically matching the split ring resonator to the feeding probe without the need for a matching network.

34. The method as recited in claim 32, wherein the feeding probe is asymmetrically and capacitively coupled to the interdigitated capacitor, the method further comprising:

shifting a main beam direction of the radiated energy to emit an asymmetric beam pattern.

* * * * *